US007173544B2

(12) United States Patent
Inoue

(10) Patent No.: US 7,173,544 B2
(45) Date of Patent: Feb. 6, 2007

(54) ON-VEHICLE DSRC APPARATUS

(75) Inventor: Masahiro Inoue, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 254 days.

(21) Appl. No.: 10/940,612

(22) Filed: Sep. 15, 2004

(65) Prior Publication Data

US 2005/0239429 A1 Oct. 27, 2005

(30) Foreign Application Priority Data

Apr. 23, 2004 (JP) ..... P2004-128437

(51) Int. Cl.
*G08G 1/09* (2006.01)

(52) U.S. Cl. ..... 340/905; 455/297; 455/41.2; 235/384; 341/21

(58) Field of Classification Search ..... 340/905; 455/297, 41.2; 235/384; 701/1; 341/21; 307/112
See application file for complete search history.

(56) References Cited

U.S. PATENT DOCUMENTS 6,753,773 B2 * 6/2004 Mizuno ..... 340/514
6,829,531 B2 * 12/2004 Lee ..... 701/205
6,861,958 B2 * 3/2005 Kasagi ..... 340/928
2004/0178929 A1 * 9/2004 Toyama ..... 340/928

FOREIGN PATENT DOCUMENTS

JP 2000-099780 A 4/2000
JP 2002-150335 A 5/2002

* cited by examiner

*Primary Examiner*—Jeffery Hofsass
*Assistant Examiner*—Hoi C. Lau
(74) *Attorney, Agent, or Firm*—Sughrue Mion, PLLC

(57) ABSTRACT

Most of on-vehicle DSRC apparatus are mounted on a dashboard of a vehicle and downsized not to hinder vision. Therefore the number of switches disposed on a panel is limited, while increase in number of functions is expected. Moreover, since an on-vehicle DSRC apparatus is operated while driving, a function key method adapted to operate keys visually is not applicable. Accordingly, an apparatus capable of performing multiple functions, in which can be assigned to one switch and operation can be performed without viewing, is demanded. A press button is operated to punch Morse code. Different functions are preliminarily allotted to respective punching patterns. A switch determination section stores the allotted functions, analyzes a press pattern and determines a function to be allotted. One switch serves multiple functions including sound volume setting, history confirmation, and on-vehicle apparatus identification number, achieving a small size on-vehicle DSRC apparatus at reasonable price.

15 Claims, 12 Drawing Sheets

| PATTERN No. | PRESS STATE | USE |
|---|---|---|
| 1 | LONG PRESS NOT LESS THAN 3 SECONDS | 1 |
| 2 | LONG PRESS NOT LESS THAN 2 SECONDS TWICE | 2 |
| 3 | | 3 |
| | | 4 |
| ⋮ | ⋮ | ⋮ |

| PATTERN NO | PRESS STATE | USE | |
|---|---|---|---|
| | | NO CARD INSERTION | CARD INSERTION |
| 1 | LONG PRESS NOT LESS THAN 3 SECONDS | 3 | 4 |
| 2 | LONG PRESS NOT LESS THAN 2 SECONDS TWICE | 5 | 6 |
| 3 | NOT LESS THAN 3 TIMES OF PRESS IN 1 SECOND | 7 | 8 |
| 4 | ⋮ | ⋮ | ⋮ |
| ⋮ | | | |
| n | NOT CORRESPONDENT WITH ANY OF ABOVES | SOUND VOLUME SETTING | 2 |

FIG. 7

| FIRST SWITCH STATE \ CARD SWITCH STATE | PATTERN 1 | PATTERN 2 | PATTERN 3 | ---------- | |
|---|---|---|---|---|---|
| PATTERN 1 | USE 1 | USE 2 | USE 3 | ---------- | |
| PATTERN 2 | USE 11 | USE 12 | 13 | ---------- | |
| 3 | 21 | 21 | 23 | ---------- | |
| 4 | 31 | 32 | ---------- | ---------- | |
| ⋮ | | | | | |

FIG. 11

ON-VEHICLE DSRC APPARATUS

BACKGROUND OF THE INVENTION

1. Field of the Invention

The present invention relates to an improvement in an on-vehicle apparatus for use in a dedicated short-range communication system to be mounted on an automobile. More specifically, the invention relates to an on-vehicle apparatus provided with means for making use of one switch in a multifunctional way.

2. Description of the Related Art

In an automobile traveling on open roads, a Dedicated Short-Range Communication (hereinafter abbreviated as "DSRC") system of Intelligent Transport Systems (hereinafter abbreviated as "ITS") is getting popular. In the DSRC, the so-called on-vehicle apparatus provided with a radio communication section that performs communication with roadside radio equipment is used.

With this on-vehicle apparatus, a user (driver) can pay a turnpike toll, or can receive information regarding traffic jam situation of roads. Further, it is necessary for the on-vehicle apparatus to be mounted within easy reach of a driver so that the driver can operate it himself. Since the DSRC is a system that has recently started to be common, it is often attached to a vehicle afterward (i.e., the DSRC is attached after a vehicle has been manufactured and started in use). There are many cases where the DSRC is mounted on a dashboard onto which the DSRC is easily mounted. However, on the supposition that this apparatus may hinder vision, safety will be impaired, and therefore the on-vehicle apparatus is required to be as downsized as possible.

In order to meet such a request for downsizing, for example, an appearance of an on-vehicle apparatus is shown in FIG. 1 of the Japanese Patent Publication (unexamined) No. 150335/2000. On a front face of the on-vehicle apparatus of this drawing, there are provided two press button switches (external input sections 12, 13), a slot (5) into which a card such as cash card is inserted, and a display section (10). The two press buttons possess such single functions as are for sound volume setting or for history confirmation respectively. Further, in some apparatus, two switches have an UP/DOWN function by which a plurality of functions that are indicated on the display lined up vertically, are sequentially scrolled and selected.

In the initial stage when kind of services to be performed by a DSRC is only to pay the toll of a turnpike road, two press button switches are sufficient. However, in view of the situation that kind of services capable of being provided by a DSRC system has been increasing recently, the need to increase the number of press button switches arises.

However, this increase in number of press button switches induces the increase in panel area on the front face, which fact goes counter to the aforementioned request of downsizing. Thus, the number of press button switches cannot be increased. Consequently, a problem exists in that kind of services capable of being provided by an on-vehicle apparatus have to be limited. Moreover, since the apparatus of the above-mentioned selective type should be operated basically while visually reading characters or instruction on the display panel, it cannot be used during driving a vehicle. Thus, a further problem exits in that the apparatus of selective type cannot be basically employed as an on-vehicle apparatus.

As a matter of course, the art in which one switch has plural functions by making use of the so-called function key is generally applied to an electronic calculator or a cellular phone. However, the method of utilizing such a function key is less likely to apply without the assumption that instructions indicated on a switch face can be exactly read. Accordingly, operating a function key is difficult in DSRC on-vehicle apparatus that is often used while driving a car.

SUMMARY OF THE INVENTION

As mentioned above, according to the conventional DSRC on-vehicle apparatus, a user can use two switches, each possessing a single function for sound volume setting or for history confirmation.

It is, however, a recent increasing need that on-vehicle apparatus has multiple functions including sound volume adjustment, history confirmation, on-vehicle identification number and accumulative history, eventually resulting in the requirement for a large number of switches to be located. However, there arises a problem that the number of switches cannot be increased since such a construction is not desirable in view of the need for downsizing the on-vehicle apparatus. Moreover, there is a further problem that the increase in the number of switches brings about a sharp rise in price of the on-vehicle apparatus.

The present invention was made to solve the above-mentioned problems and has an object of providing an on-vehicle apparatus in which applicable functions can be increased to a large extent by apparently increasing the number of functions of a switch without increasing the number of switches; and the function of a switch can be switched to any of plural intended ways of use without viewing a character face on a press button or a display face at all, resulting in easy utilization.

An on-vehicle DSRC apparatus according to the invention is used in a dedicated short-range communication system of intelligent transport systems that is mounted on a vehicle traveling on a road. This DSRC on-vehicle apparatus includes: a radio communication section carrying out a communication with information radio equipment provided on a roadside; a sound volume setting section setting a sound volume of a speaker that announces information with a voice; a first switch of a press button type that is located on a panel front face and has the mentioned sound volume setting function; and a switch determination section that detects connection/disconnection situation of the mentioned first switch with an elapse of time and recognize it as a pattern in the course of the time, compares it with a plurality of the mentioned patterns having been preliminarily stored, and allots a function having been assigned to the mentioned pattern with which the current pattern is coincident to the mentioned first switch on condition that the current pattern is coincident with any of said plural patterns having been preliminarily stored.

In the DSRC on-vehicle apparatus of above constitution, not only one switch can be used as a multi-functional switch, but also a user can switch multi-functions thereof without viewing displays on a panel face or characters on the switches. Consequently, it is possible to achieve price-reduction, and to achieve downsizing of the on-vehicle apparatus.

Further, in this DSRC on-vehicle apparatus, one switch can be used as that bears both functions of sound volume setting and utilization history confirmation depending on insertion or pulling out of a card, thereby enabling to achieve the usage that fits the feeling of user. In addition, it comes to be unnecessary to store the procedure of the switch being pressed, thereby enabling to simplify the constitution of a switch determination section 1.

Other objects, features, aspects and advantages of the present invention will become more apparent from the following detailed description of the present invention when taken in conjunction with the accompanying drawings.

BRIEF DESCRIPTION OF THE DRAWINGS

FIG. 7 is an explanatory table of patterns of pressing a switch for explaining the operation of FIG. 6.

FIG. 11 is an explanatory table of patterns of pressing a switch for explaining the operation of FIG. 10.

DETAILED DESCRIPTION OF THE INVENTION

Embodiment 1.

According to an on-vehicle DSRC apparatus of the present invention, just one switch can be used as that performs a plurality of functions (ten functions). However, for easier comprehension, according to this first preferred embodiment, an embodiment of making use of one switch as that has simple three functions is hereinafter described.

Figure 1:
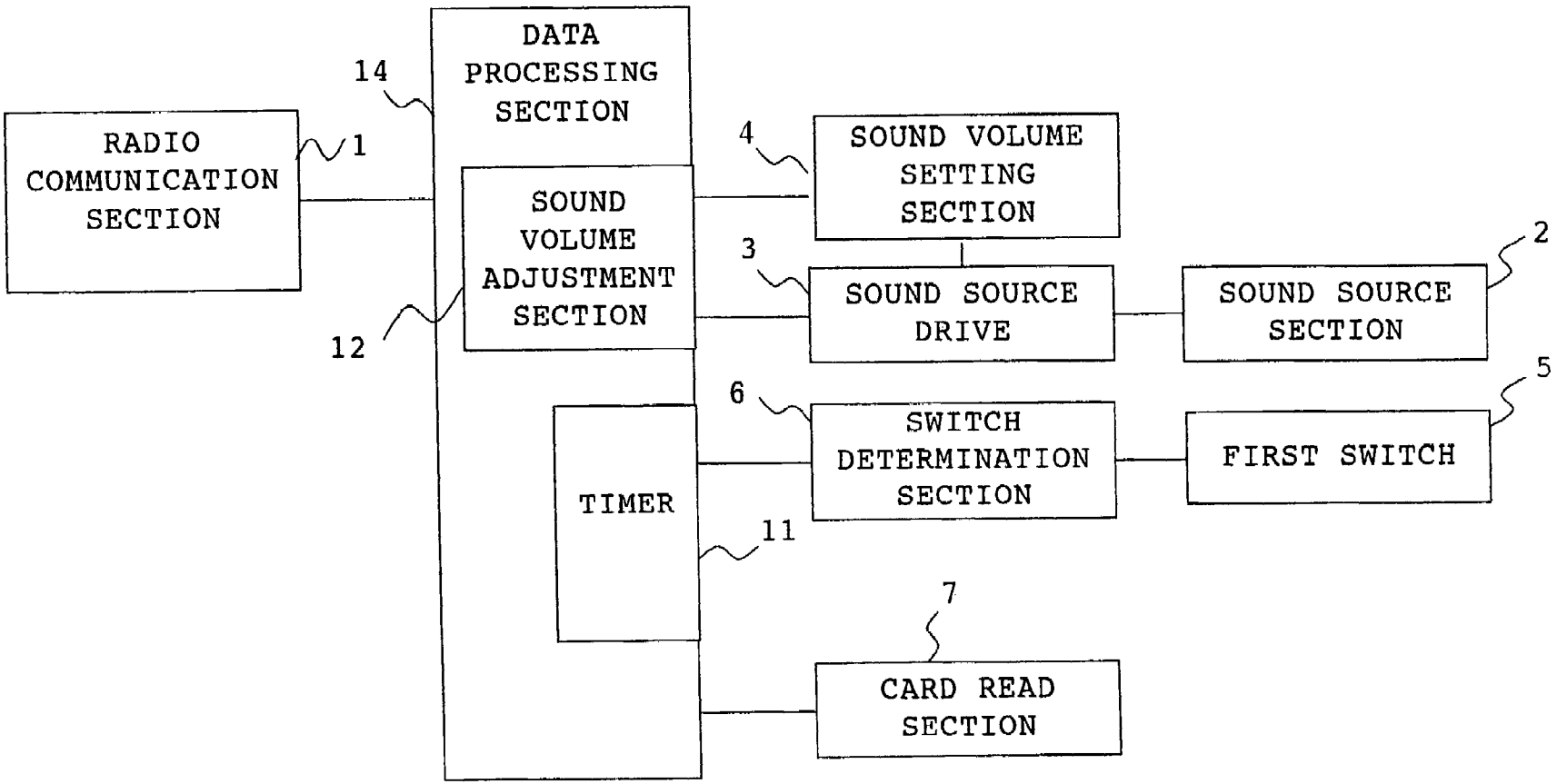
FIG. 1 is a block diagram of an on-vehicle DSRC apparatus according to a first preferred embodiment.
Figure 2:
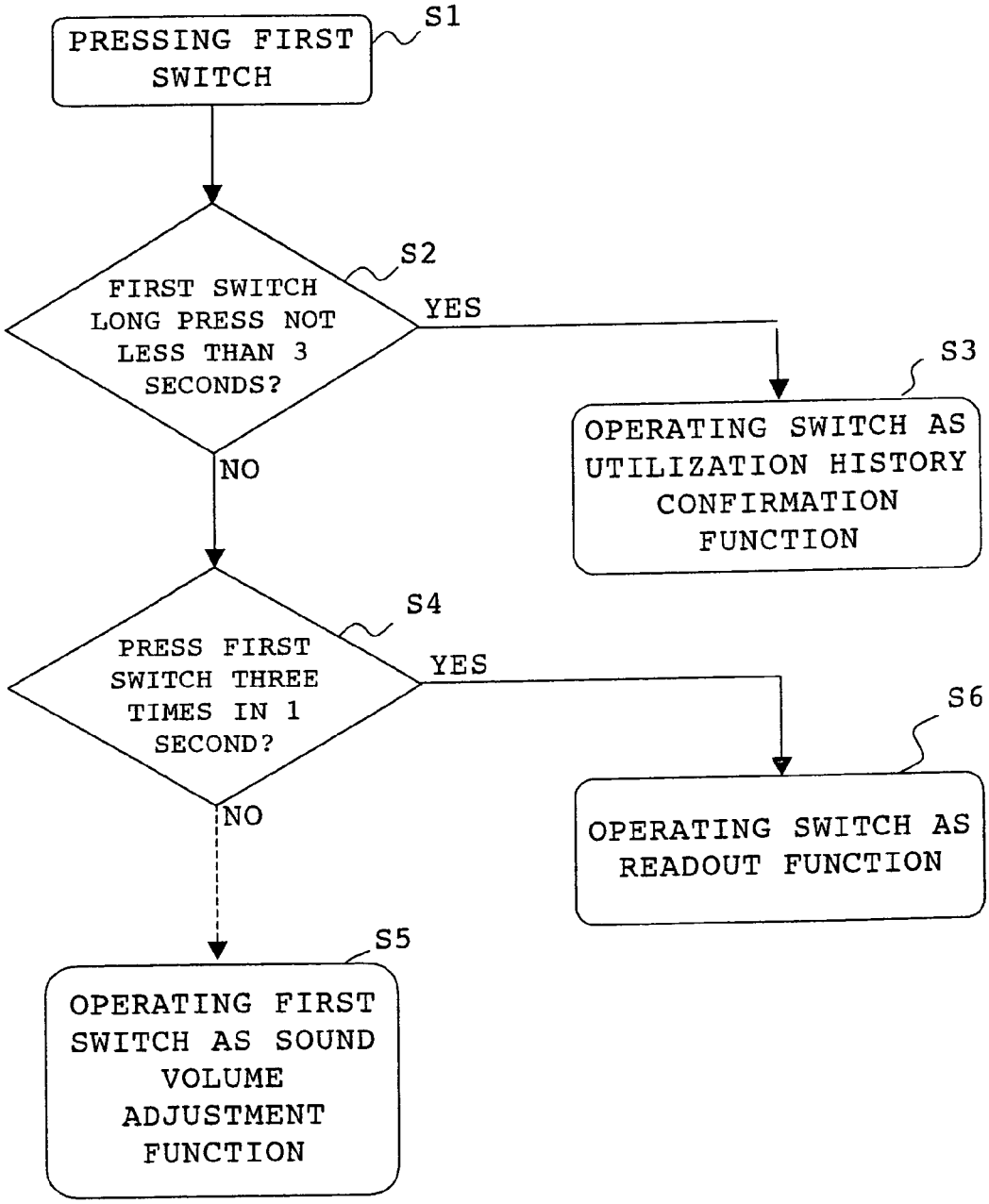
FIG. 2 is a flowchart for explaining the operation of FIG. 1.
Figures 3, 4:
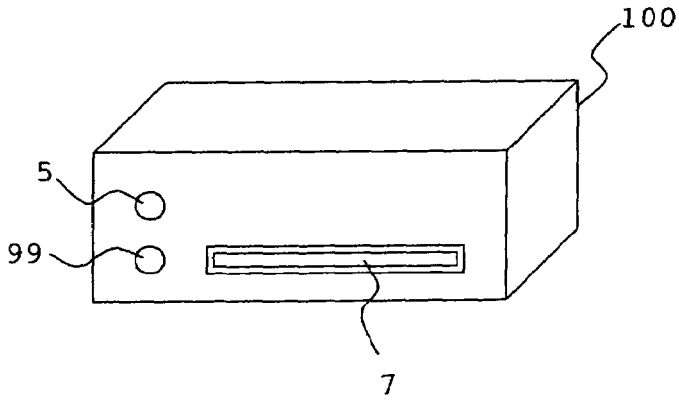
FIG. 3 is an explanatory table of patterns of pressing a switch for explaining the operation of FIG. 1.
FIG. 4 is an external view of a panel face of an on-vehicle DSRC apparatus of FIG. 1.

FIG. 1 is a block diagram of an on-vehicle DSRC apparatus according to the first embodiment of this invention, FIG. 2 is a flowchart explaining the operation of FIG. 1, FIG. 3 is an explanatory table of allotting functions for explaining the operation of FIG. 3, and FIG. 4 is an external view. Referring to FIG. 1 showing a function block of an on-vehicle apparatus, this on-vehicle apparatus includes: a radio communication section 1 for carrying out a radio communication with on-road DSRC equipment, not shown; a sound source section 2 such as speaker or buzzer that generates sound and informs a user of information; a sound source drive 3 constituted of, e.g., sound amplifier for driving the mentioned sound source section 2; a sound volume setting section 4 that controls the mentioned sound source drive 3 and sets a sound volume of the mentioned sound source section 2; a first switch 5 which can be pressed by a user of the on-vehicle apparatus with a hand; a switch determination section 6 that detects a way of the first switch 5 being pressed (although the details are described later, it is referred to as "pattern"), and determines an intended way of use (function) of the first switch 5; a card read section 7 that reads information of a card, now shown, to be inserted into the on-vehicle apparatus; and a data processing section 14 provided with an arithmetic processing unit or memory, not shown, that synthetically controls these sections.

In addition, the usage of a card read section 7 is described from the descriptions of Embodiment 3 on.

The data processing section 14 is a device serving various functions with a plurality of software. For reasons of description, however, only a timer 11 and a sound volume adjustment section 12 are shown, and the constitution of the data processing section 14 is described.

Voice of an on-vehicle DSRC apparatus makes a guide to the effect that a vehicle can go through a tollbooth of entrance in a normal manner, and vocalizes a toll having been used at a tollbooth of exit. Normally, the mentioned first switch is used for adjusting a sound volume in which this information is vocalized. Further, a sound volume can be set step-by-step every time the first switch 5 is pressed.

At an initial stage in which a power supply is turned on, the first switch 5 possesses a function as a sound volume setting device directing the sound volume setting section 4 to change a level of the sound volume (hereinafter referred to as "first intended use").

In the on-vehicle DSRC apparatus, utilization history such as toll is stored in a card not shown. It is necessary for a user to read out the utilization history thereof to confirm an amount of balance. In that case, by pressing the first switch 5 according to a pressing procedure (of which details are described later) that has been preliminarily stored in the mentioned switch determination section 6, the first switch 5 can be used as a switch not for setting a sound volume but for reading out the utilization history (hereinafter referred to as "second intended use").

Now, a procedure of pressing the mentioned first switch 5 is described.

Normally, in the case where a user sets a sound volume with the first switch 5, the switch is not pressed continuously so long. The reason comes from the fact that in case of the switch continuing to be pressed for a long time period, a sound volume is set to be the maximum or the minimum, and does not change any more. Then, in the case where this switch is utilized for a different use, a specific procedure (hereinafter referred to as "pattern") in which a user is less likely to press the switch at ordinary times is preliminarily stored. For example, the way of pressing based on a long press such as the case of pressing the first switch long continuously for not less than 3 seconds, or the case of pressing twice the first switch for not less than 2 seconds in series with a short time period interposed between these two long presses, has been stored. Thus, it is arranged such that, in the case where the first switch is pressed according to the mentioned procedure, the first switch 5 can be used as a switch for an intended use other than the use for sound volume setting.

Operation of the switch determination section 6 for switching uses of the first switch is described with reference to an operation flowchart of FIG. 2. First, in (Step S1), the first switch 5 is pressed. A state of the first switch 5 being pressed (pattern over the elapse of time) is stored by storage means, not shown, of the switch determination section 6. Then, in (Step S2 onward), it is sequentially compared and determined whether or not the current press state is coincident with any of plural press states that are described in a referencing table of press states having been preliminarily stored in storage means, not shown. When the current press state is coincident with, for example, a long press of not less than 3 seconds (Step S2), it is determined from FIG. 3 that the current press state is use 1 (e.g., utilization history confirmation function) (Step S3). In the case where there is no coincidence, subsequently the current press state is compared with the next referential press state in (Step S4). Such a comparison continues in sequence. Then, in the case where the current press state has not been coincident with any of the referential press states after all, the first switch 5 serves a function of original sound volume setting.

Also in the case where the first switch 5 is used for calling an on-vehicle apparatus identification number, making a call of error log, or confirming an accumulative charge other than the sound volume setting (the first use) and the utilization history (the second use), procedures of pressing the first switch as described above have been preliminarily determined. Further, supposing that the first switch 5 is set so as to function as an utilization history switch in the case of pressing long continuously for not less than 3 seconds, and so as to function as the other switch in the case of pressing it three times in 1 second, one switch can be used as plural switches. Further, it is preferable that the switch returns to the function of the original sound volume setting in the case where the switch is not used for a predetermined time period. However, it is also preferable that the procedures of pressing the switch have been preliminarily determined as described above, and the current procedure thereof is determined by the switch determination section 6 to return the switch to the function of sound volume setting. Furthermore, it is also preferable that in the case of turning a power supply switch, not shown, OFF, the switch is returned to the function of sound volume setting at the next time of turning the power supply switch ON.

As a result of such arrangement, a plurality of uses can be set with the first switch 5 that is provided on a panel face as shown in FIG. 4, thereby enabling to achieve downsizing of the on-vehicle apparatus.

Embodiment 2.

Although the first switch 5 bears plural uses in the foregoing first embodiment, only two ways are shown as an example thereof. To increase functions of the switch up to a number of several tens, it is required that several tens kinds of press states (patterns) to be identified that are described in the foregoing first embodiment are determined. Herein, a specific manner of determination is shown as an example.

Figure 5:
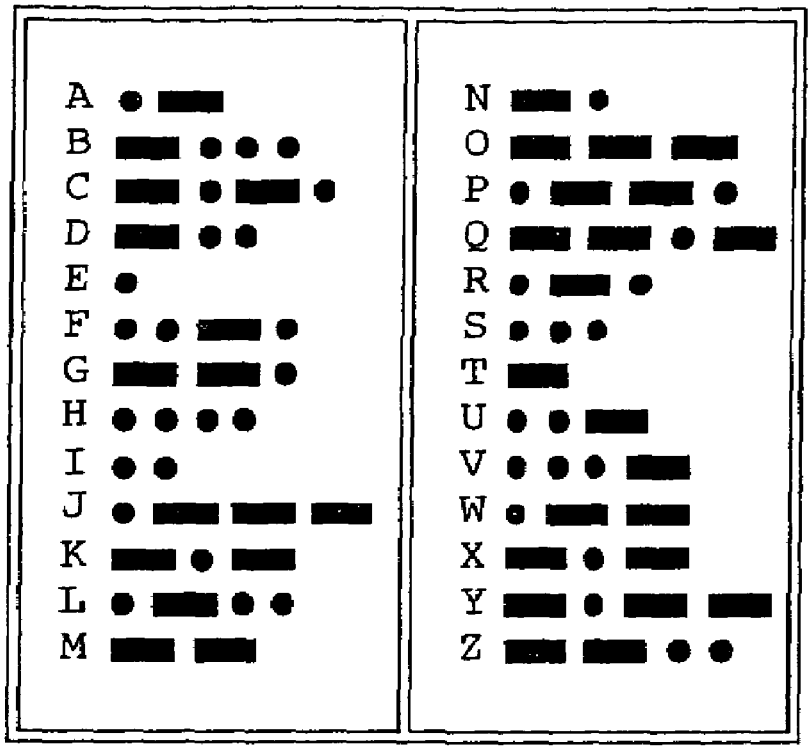
FIG. 5 is a Morse code table explaining the operation of FIG. 1.
Figure 5:
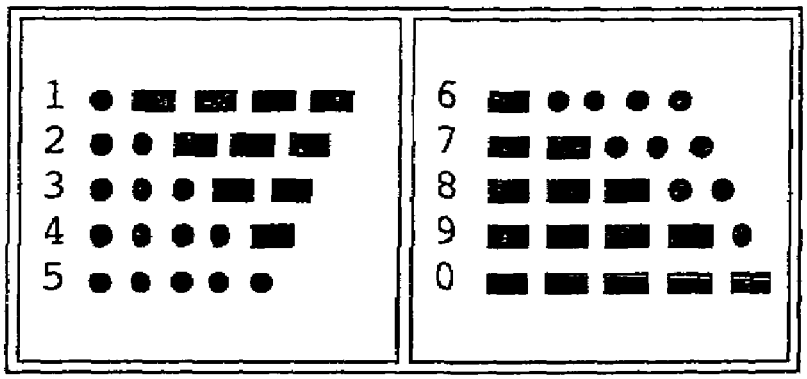

FIG. 5 is a code table of alpha-numerals and ten-odd codes of Morse signals, which is a well-known data.

When Morse codes are manually punched through the first switch 5, a speed of the punching or a ratio between dash and dot varies depending upon person. However, even if the punching is carried out in various speeds, it is possible in the known art heretofore to arrange that the switch determination section 6, which is shown in FIG. 1 of the first embodiment, can identify the Morse codes of FIG. 5.

By allotting respective Morse codes of FIG. 5 to different uses, it comes to be possible to allot not less than 40 kinds of intended uses. Although it is possible in principle to allot more uses by combining a plurality of codes, it becomes too complicated making it hard for a general user to utilize them. Consequently, making codes so complicated cannot be said to be a desirable embodiment of usage.

Embodiment 3.

Figure 6:
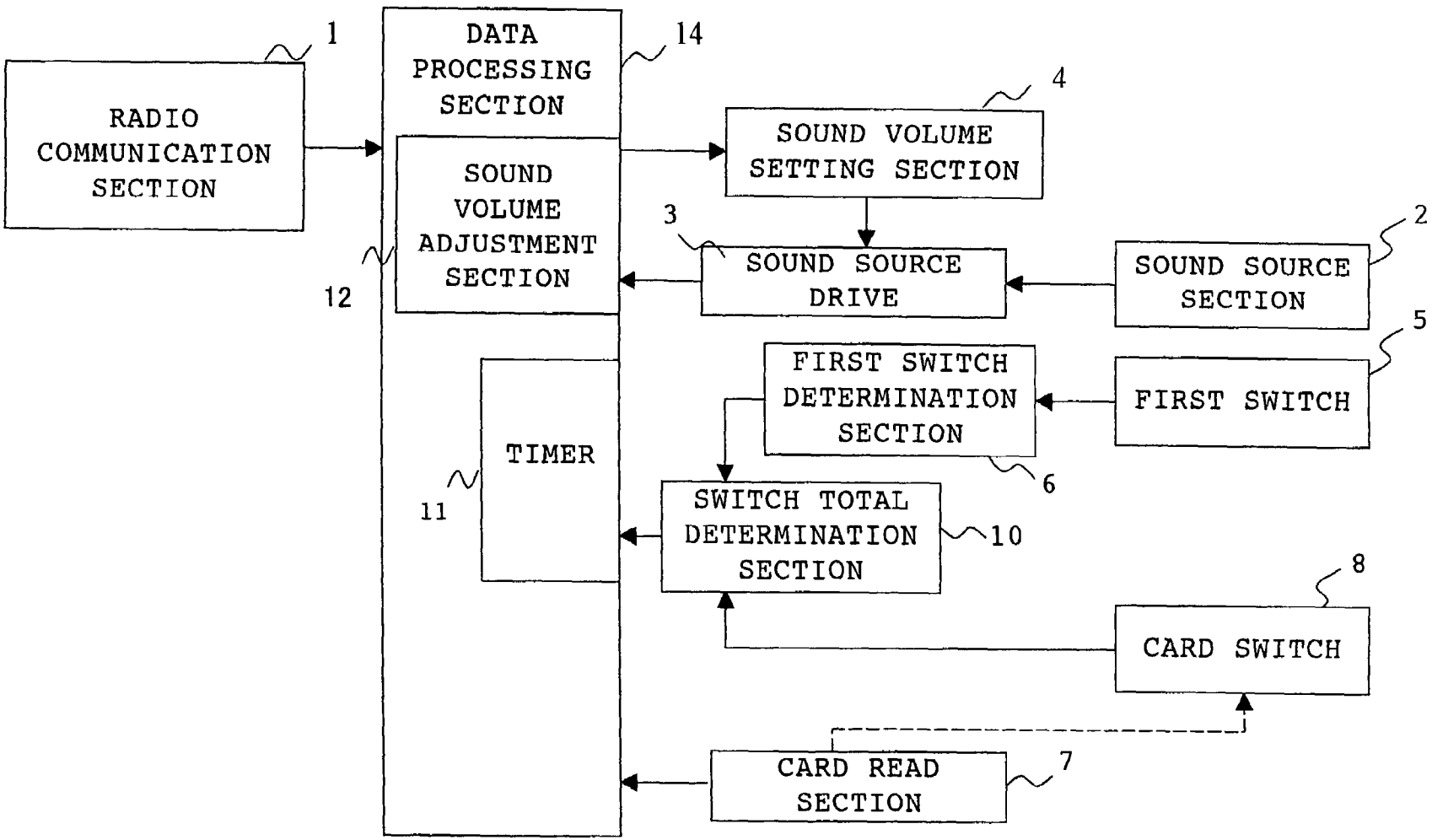
FIG. 6 is a block diagram of an on-vehicle DSRC apparatus according to a second preferred embodiment.

FIG. 6 is a block diagram of an on-vehicle DSRC apparatus according to a third preferred embodiment. In this embodiment, in addition to the block of FIG. 1 according to the foregoing first embodiment, a card switch 8 is provided. This card switch 8 comes to be ON when a user inserts a card that stores electronic information into the card read section 7 of the on-vehicle apparatus, and comes to be OFF when the user pulling the card out of the card read section 7 of the on-vehicle apparatus. A switch total determination section 10 is also provided. This switch total determination section 10 determines a use to be allotted as final use based on a determination result of the switch determination section 6 and an ON/OFF state (hereinafter referred to as "pattern over the elapse of time") of the card switch 8.

Figure 8:
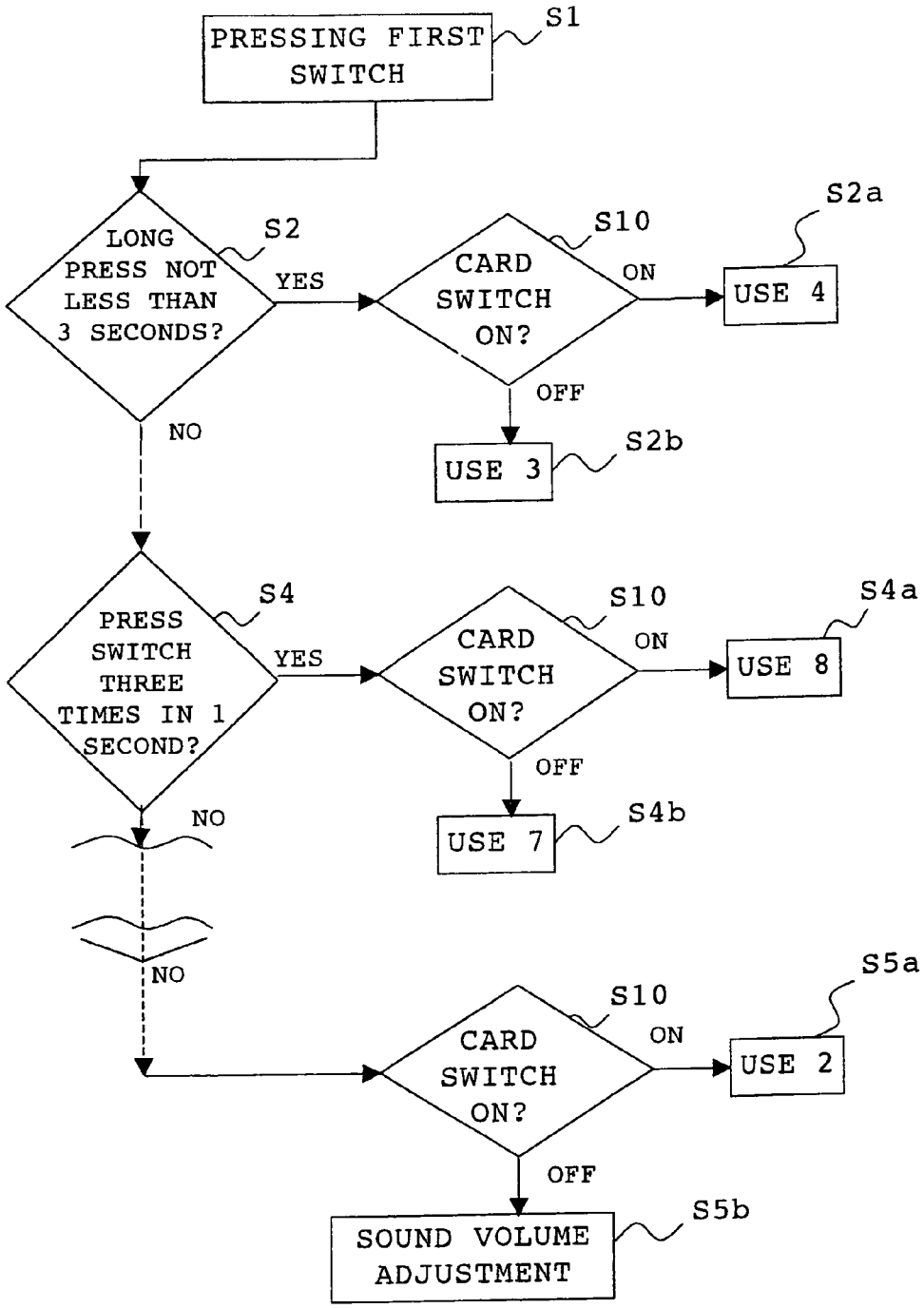
FIG. 8 is a flowchart for explaining the operation of FIG. 6.

FIG. 7 shows determination examples of uses to be switched depending on cases of ON and OFF of the card switch 8. FIG. 8 is a flowchart for explaining the operation.

In the case where the first switch 5 is pressed long, for example, for not less than 3 seconds (Yes in Step S2) and where the card is in the state of being inserted in Step S10 (the state in which the card switch 8 is ON), Use 4 is determined (Step S2*a*). On the contrary, in the case where the card is not inserted in Step S10, Use 3 is determined in Step S2*b*.

In the case where the first switch 5 is pressed three times in 1 second (Step S4) and where the card is inserted, Use 8 is determined in Step S4*a*. In the case where the card has not been inserted yet, use 7 is determined in Step S4*b*. It is possible to arbitrarily determine what function is specifically assigned to each use.

In the case where such determinations as mentioned above continue in sequence, the current press state does not correspond to any pattern described in FIG. 7 and the card switch 8 is in the sate of ON (the determination in Step S10 is ON), a use of the first switch 5 is determined to be Use 2. In the case of pressing the first switch 5 in a press way of not described in Table 7 under the state that the card switch 8 is in the state of OFF, that is, the card is not inserted in the on-vehicle apparatus, the first switch 5 functions as a switch of sound volume setting in Step S5*b* (Step S5).

In the above descriptions, the switch total determination section 10 of FIG. 6 carries out final determination of use based on the determination in Step S10.

Embodiment 4.

Figure 9:
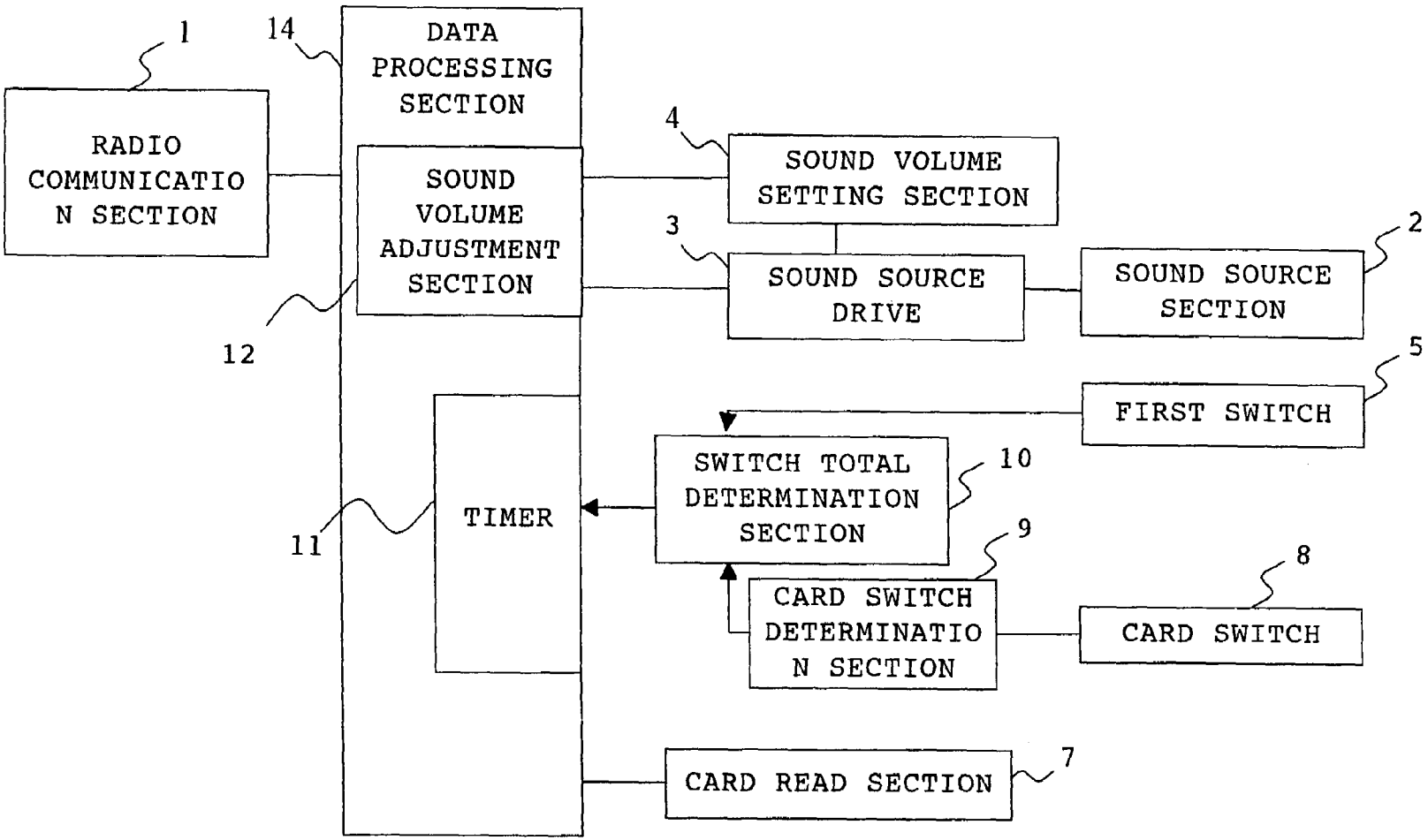
FIG. 9 is a block diagram of an on-vehicle DSRC apparatus according to a third preferred embodiment.

Referring now to FIG. 9, a card switch determination section 9 is provided in this embodiment. This card switch determination section 9 detects a state of ON/OFF of the card switch 8 (which is the same ON/OFF state of the first switch 5 as is described in the first embodiment), and determines a use of the card switch 8 based on the detection result. The card switch determination section 9 possesses the same arrangement or like function to the switch determination section 6 that is described in the foregoing first embodiment. That is, plural patterns of changing procedures of ON/OFF state of the card switch 8 have been preliminarily stored (which is the same as FIG. 3 in the first embodiment). When a user carries out inserting or pulling out the card according to the series of procedures thereof, coincidence with any procedure is determined, and a determination result is reported to the switch total determination section 10.

Also in this case, the procedures of ON and OFF of the card switch 8 to have been stored preliminarily in the card switch determination section 9 are arranged to be those not coincident just by the normal insertion or pulling out of a card. For example, in the case of inserting or pulling out a card three times within 1 second, or in the case of repeating three times the operation of inserting the card again within 1 second after the card has been pulled out, the mentioned first switch 5 is caused to function as that for the other intended use (function) having been specifically determined.

For easy understanding, with reference to FIG. 9, the first switch is used as a simple switch bearing one function, and the switch determination section 6 is not employed.

A determination example of the card switch 8 to be determined in accordance with the way of the card switch 8 being pressed is the same as in FIG. 3 of the first embodiment.

Embodiment 5.

Figure 10:
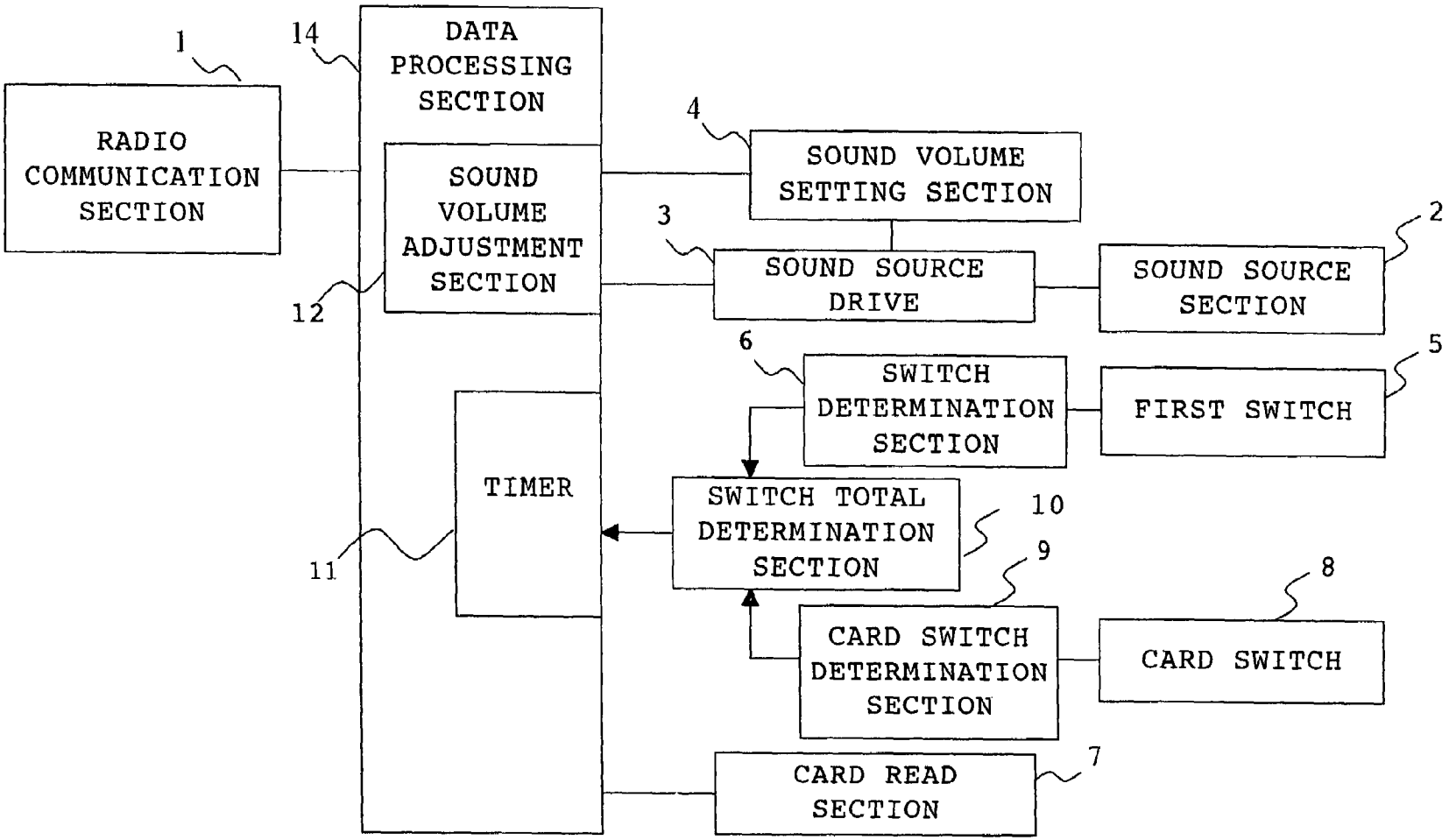
FIG. 10 is a block diagram of an on-vehicle DSRC apparatus according to a fifth preferred embodiment.

Referring now to FIG. 10, a switch total determination section 10 is provided in this embodiment. This switch total determination section 10 determines a function of the first switch 5 based on a determination result of the switch determination section 6 and the card switch determination section 9. The switch total determination section 10 causes a combination of ON/OFF and insertion procedure of the mentioned two switches to have been stored, and changes a function of the first switch 5 when an input is carried out according to the combination thereof.

The mentioned examples of combination are shown in FIG. 11. For example, when inserting a card in a pattern of X2, and then operating the first switch 5 so as to be determined as a pattern Y1 by the switch determination section 6, the switch total determination section 10 enables the first switch 1 to be used as a switch serving a function of Use 2. Furthermore, when inserting the card so as to be determined as a pattern X3 by the card switch determination section 9 and thereafter operating the first switch 5 in the pattern Y3, the switch total determination section 10 determines Use 23 of the first switch 5.

That is, the determination of a function of the first switch 5 is carried out based on an insertion pattern of the card having been conducted before (or immediately before) the determination. In case of causing the first switch 5 to provide multiple functions with operation patterns thereof, there may be a problem in that it is hard for an operator to remember the patterns. However, by employing the combinations of FIG. 11, it comes to be possible to determine a number of uses with less number of patterns.

Embodiment 6.

In each of the embodiments described heretofore, there is a possibility of forgetting to which use the first switch has been set in the case where no operation is carried out for a while after the first switch is switched from a basic function (for example, sound volume setting) to the other use. It may be an idea to indicate a determined use on the display at the time of determining the use as a matter of course. However, a driver can hardly afford to confirm it during driving a vehicle.

To meet this, there is provided a timer 11 that regulates a time period while a determined function can be used after a function of the first switch 5 has been determined by the switch determination section 6 in FIG. 1. When a time period during which no switch operation is made exceeds a time period having been preliminarily determined by the timer 11 in the case of switching a function of the mentioned switch from a sound volume setting function, being a basic function, to intended uses having been determined depending on patterns, for example, utilization history confirmation function or a function of calling an on-vehicle identification number in the foregoing Embodiments 1, 2, 3 or 4, the program automatically causes a function of the first switch 5 to return to the original sound volume setting function.

Furthermore, it is also preferable to return to the original sound volume setting function when a time period that is determined by the timer 11 has passed after detecting that the card has been pulled out based on the result of determination made by the card switch determination section 9.

Embodiment 7.

With reference to FIG. 1, reference numeral 12 designates a sound volume adjustment section storing a sound volume set value that is set with respect to the mentioned sound volume setting section at the time of setting a sound volume, and a vocalization content for causing the mentioned sound source section to make a voice relevant to a sound volume thereof. In the case of using the mentioned switch as that of sound volume setting function, a sound volume set value is increased step-by-step such that, e.g., one press sets a current sound volume, two presses set a sound volume of the next grade, and three presses set a sound volume of the subsequent grade; thus a sound volume set value proceeds up to the maximum volume, and then returns to the minimum volume. At this time, the sound volume adjustment section sets a magnitude of a sound volume to be set for the sound volume setting section, and sets data for the sound source drive so as to cause the sound source drive to vocalize information relating to a sound volume, for example, numerals that indicate a level of volume at that time.

For example, in the case where sound volumes are adjusted into three stages, data is set with respect to the sound volume setting section and the sound source drive from the sound volume adjustment section so as to cause the sound source drive to vocalize "first" in a small sound volume at the first stage, "second" in a medium sound volume at the second stage, and "third" in a large sound volume at the third stage.

In this manner, it is possible for a user to confirm a sound volume level intended to set by himself with both number announce and actual volume, thereby enabling to set an optimum sound volume without fail.

Furthermore, it is preferable not to represent a vocalization content with "first, second . . . ", but to set a vocalization content to be in a buzzer sound such as "feeping" (of which frequency becomes high as a sound volume level elevates). Further, it is preferable to indicate contents in the other way of vocalization.

Embodiment 8.

Figure 12:
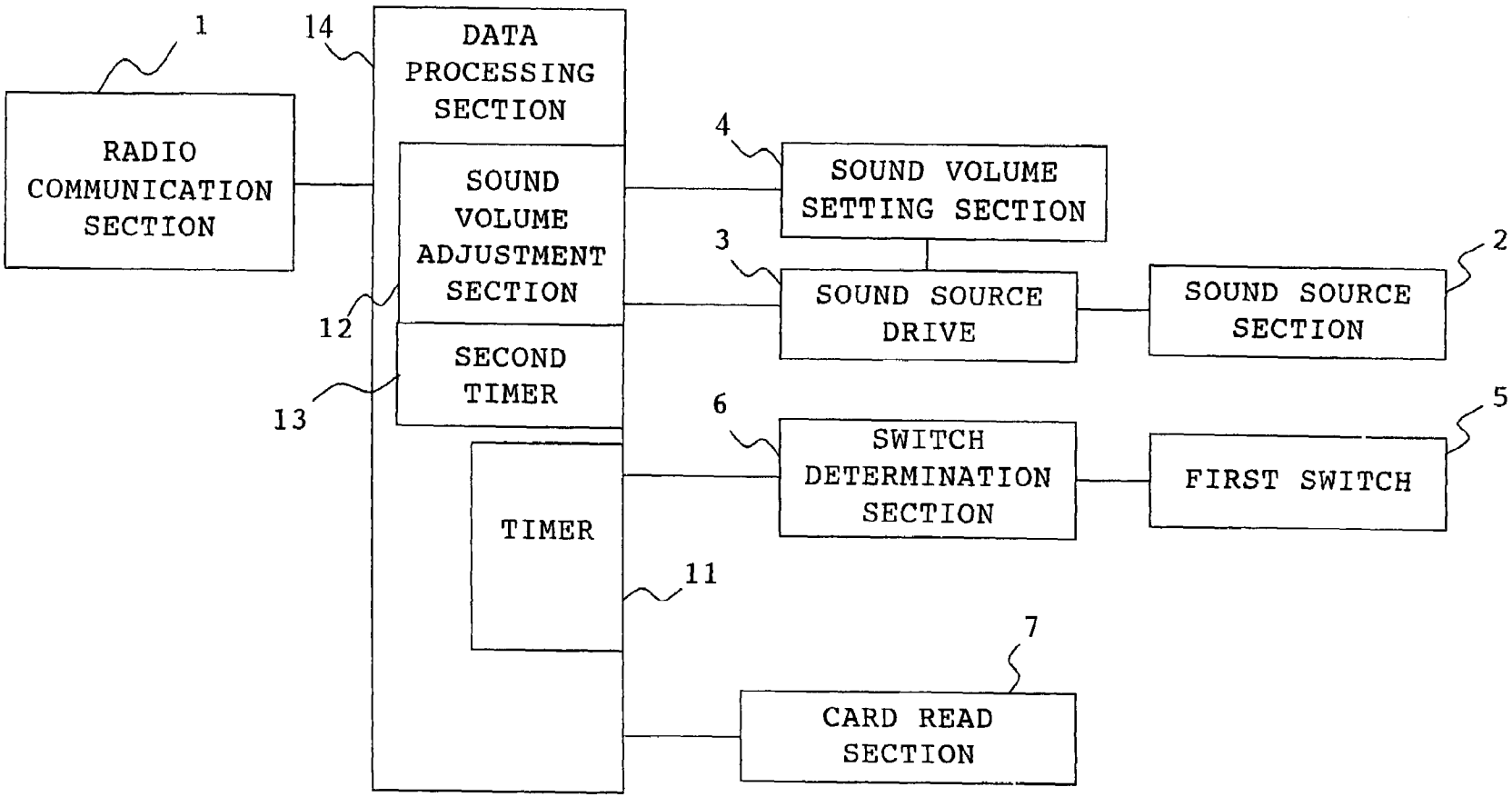
FIG. 12 is a block diagram of an on-vehicle DSRC apparatus according to an eighth preferred embodiment.
Figure 13:
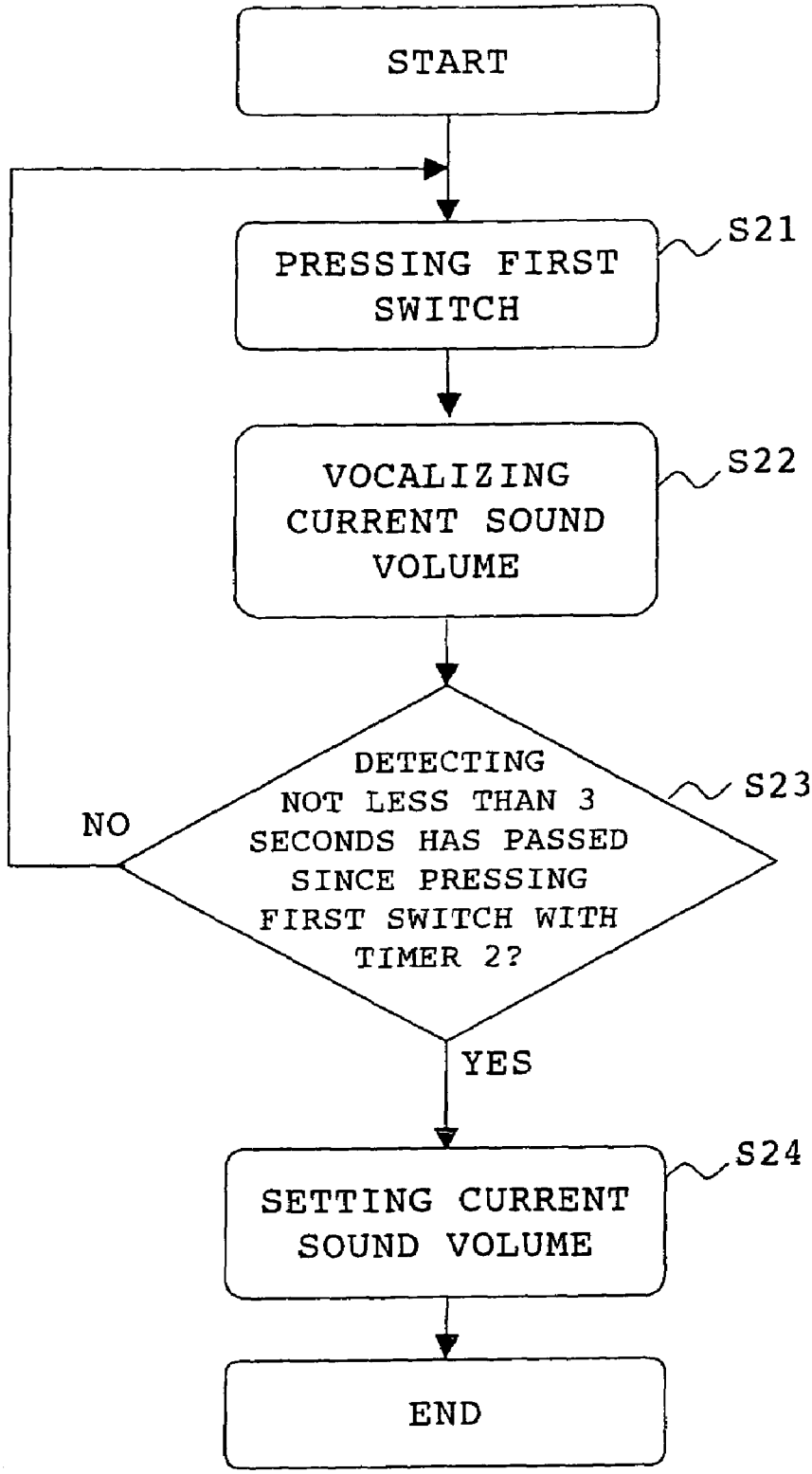
FIG. 13 is a flowchart for explaining the operation of FIG. 12.

Referring now to FIG. 12, a second timer 13 is provided for determining a sound volume set value in this embodiment. Operation thereof is described with the use of a flow of FIG. 13. When carrying out the sound volume setting described in the seventh embodiment, the first switch 5 is pressed (Step S21), the vocalization for setting such as "first", or "second" is made (Step S22), and thereafter it is checked whether or not a time period that is set by this second timer 13 has passed (Step S23). Then, after a predetermined time period has passed, a set value is stored in a storage medium, not shown, for the purpose of determining a sound volume when the vocalization is made after that moment (Step S24).

At this time, it is also preferable to announce, e.g., "it is determined to be the second" in order to notify again a user of which sound volume has been determined.

An on-vehicle DSRC apparatus according to this invention is not limited to applications of specific functions/uses of a switch, described in the foregoing embodiments, but can be utilized for more different functions/different uses, not described herein.

While the presently detailed embodiments of the present invention have been shown and described. It is to be understood that these disclosures are for the purpose of illustration and that various changes and modifications may be made without departing from the scope of the invention as set forth in the appended claims.

What is claimed is:

1. An on-vehicle DSRC apparatus for use in a dedicated short-range communication system of intelligent transport systems, and which is mounted on a vehicle traveling on a road, the DSRC on-vehicle apparatus comprising:

a radio communication section carrying out a communication with information radio equipment provided on a roadside;

a sound volume setting section setting a sound volume of a speaker that announces information with a voice;

a first switch of a press button type that is located on a panel front face and has said sound volume setting function; and a switch determination section that detects a connection/disconnection of said first switch with an elapse of time and recognizes said connection/disconnection as a pattern in the course of the time, compares said pattern with a plurality of patterns having been preliminarily stored, and allots a function having been assigned to said pattern with which a current pattern is coincident to said first switch on condition that the current pattern is coincident with any of said plurality of patterns having been preliminarily stored.

2. The DSRC on-vehicle apparatus according to claim 1, further comprising a card read section reading a card that stores electronic information and including a card switch that operates in response to said card being inserted or pulled out; and a switch total determination section changing a function, which said switch determination section allots, depending on ON/OFF of said card switch.

3. An on-vehicle DSRC apparatus for use in a dedicated short-range communication system of intelligent transport systems, and which is mounted on a vehicle traveling on a road, the DSRC on-vehicle apparatus comprising:

a radio communication section carrying out a communication with information radio equipment provided on a roadside;

a sound volume setting section setting a sound volume of a speaker that announces information with a voice;

a first switch of a press button type that is located on a panel front face and has said sound volume setting function;

a card read section reading a card that stores electronic information and including a card switch that operates in response to said card being inserted or pulled out;

a card determination section that detects a connection/disconnection of said card switch with an elapse of time and recognizes said connection/disconnection as a pattern in the course of the time, compares said pattern with a plurality of patterns having been preliminarily stored, and allots a function having been assigned to said pattern with which the current pattern is coincident to said card switch on condition that the current pattern is coincident with any of said plurality of patterns having been preliminarily stored; and a switch total determination section changing a function, which said card determination section allots, depending on ON/OFF of said first switch.

4. An on-vehicle DSRC apparatus for use in a dedicated short-range communication system of intelligent transport systems, and which is mounted on a vehicle traveling on a road, the DSRC on-vehicle apparatus comprising:

a radio communication section carrying out a communication with information radio equipment provided on a roadside;

a sound volume setting section setting a sound volume of a speaker that announces information with a voice;

a first switch of a press button type that is located on a panel front face and has said sound volume setting function; and a switch determination section that detects connection/disconnection of said first switch with an elapse of time and recognizes said connection/disconnection as a contact pattern in the course of the time, compares said contact pattern with a plurality of said contact patterns having been preliminarily stored, and allots a function having been assigned to said contact pattern with which the current pattern is coincident to said first switch on condition that the current pattern is coincident with any of said plurality of contact patterns having been preliminarily stored;

a card read section reading a card that stores an electronic information and including a card switch that operates in response to said card being inserted or pulled out;

a card determination section that detects connection/disconnection situation of said card switch with an elapse of time and recognizes said connection/disconnection as a contact pattern in the course of the time, compares said contact pattern with a plurality of said contact patterns having been preliminarily stored, and allots a function having been assigned to said contact pattern with which the current pattern is coincident to said card switch on condition that the current pattern is coincident with any of said plurality of contact patterns having been preliminarily stored; and a switch total determination section assigning a function on condition that there is coincidence between a function allotted by said switch determination section and a function allotted by said card switch determination section.

5. The DSRC on-vehicle apparatus according to claim 1, further comprising a first timer that sets a length of time period during which a function that said switch determination section allots is effective.

6. The DSRC on-vehicle apparatus according to claim 2, further comprising a first timer that sets a length of time period during which a function that said switch total determination section allots is effective.

7. The DSRC on-vehicle apparatus according to claim 3, further comprising a first timer that sets a length of time period during which a function that said switch total determination section allots is effective.

8. The DSRC on-vehicle apparatus according to claim 4, further comprising a first timer that sets a length of time period during which a function said switch total determination section allots is effective.

9. The DSRC on-vehicle apparatus according to claim 1, further comprising a sound volume adjustment section storing a vocalization content for causing a sound source section that announces said volume level with voice from said speaker to make a voice relevant to a sound volume thereof when said sound volume setting function is assigned to said first switch.

10. The DSRC on-vehicle apparatus according to claim 3, further comprising a sound volume adjustment section storing a vocalization content for causing a sound source section that announces said volume level with voice from said speaker to make a voice relevant to a sound volume thereof when said sound volume setting function is assigned to said first switch or said card switch.

11. The DSRC on-vehicle apparatus according to claim 4, further comprising a sound volume adjustment section storing a vocalization content for causing a sound source section that announces said volume level with voice from said speaker to make a voice relevant to a sound volume thereof when said sound volume setting function is assigned to said first switch or said card switch.

12. The DSRC on-vehicle apparatus according to claim 8, further comprising a second timer for determining a sound volume set value.

13. The DSRC on-vehicle apparatus according to claim 10, further comprising a second timer for determining a sound volume set value.

14. The DSRC on-vehicle apparatus according to claim 11, further comprising a second timer for determining a sound volume set value.

15. The DSRC on-vehicle apparatus according to claim 1, wherein at least one of said patterns is a pattern corresponding to a Morse code.

* * * * *